US008646123B1

(12) United States Patent
Potvin et al.

(10) Patent No.: US 8,646,123 B1
(45) Date of Patent: Feb. 11, 2014

(54) POWER ACTUATED TOILET SEAT DEVICE

(76) Inventors: Denis Potvin, Brandon (CA); Diane Potvin, Brandon (CA)

( * ) Notice: Subject to any disclaimer, the term of this patent is extended or adjusted under 35 U.S.C. 154(b) by 104 days.

(21) Appl. No.: 13/458,402

(22) Filed: Apr. 27, 2012

(51) Int. Cl.
*A47K 13/10* (2006.01)

(52) U.S. Cl.
USPC ..... 4/667

(58) Field of Classification Search
USPC ..... 4/667, 561.1, 562.1, 246.2
See application file for complete search history.

(56) References Cited

U.S. PATENT DOCUMENTS 5,588,162 A 12/1996 Robinson
6,189,164 B1 2/2001 Krapu
6,438,769 B1 * 8/2002 Luckenbill ..... 4/667
6,553,585 B1 4/2003 Lundstrom
2003/0074731 A1 4/2003 Sumino
2009/0235450 A1 * 9/2009 Nugent ..... 4/667

* cited by examiner

*Primary Examiner* — Tuan N Nguyen

(57) ABSTRACT

The power actuated toilet seat device provides a pair of leg assemblies positioned on opposites sides of a toilet bowl, an expansion cylinder disposed longitudinally on each hind leg, a receiver/activator disposed downwardly in each expansion cylinder, an expansion lift arm disposed upwardly on each expansion cylinder, a follower disposed perpendicularly inward atop each expansion lift arm, a seat having a front spaced apart from a rear, and two spaced apart sides, a slot disposed laterally within each seat side, each slot in receipt of one of the followers of one of each of the expansion lift arms, a hinge disposed downwardly and at the front of the seat, the hinge selectively affixed forwardly to an existing bowl of an existing toilet, a control means configured to control lifting and pivoting of the seat, the control means in communication with each receiver/activator.

9 Claims, 3 Drawing Sheets

POWER ACTUATED TOILET SEAT DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

There are many reasons to provide assistance with lifting and lowering a toilet seat. Among those reasons is assistance for the physically challenged. Of the plurality of powered toilet seat and assisted toilet seats, many are quite complex. Many currently provided assisted toilet seats are not space efficient. And, many existing assisted toilet seat devices require either inclusion into toilet manufacture, or extensive installation procedures. The present device provides a unique power actuated toilet seat with support that is compactly and easily fitted to virtually any existing toilet, without toilet modifications, and pivotally lifts the seat forwardly.

FIELD OF THE INVENTION

The power actuated toilet seat device relates to toilet seats and more especially to a power actuated toilet seat device with support.

SUMMARY OF THE INVENTION

The general purpose of the power actuated toilet seat device, described subsequently in greater detail, is to provide a power actuated toilet seat device which has many novel features that result in an improved power actuated toilet seat device which is not anticipated, rendered obvious, suggested, or even implied by prior art, either alone or in combination thereof.

To attain this, the power actuated toilet seat device provides a forwardly pivoted seat for fit to virtually any toilet bowl. The power activated seat lifts upwardly and forwardly by expansion cylinders, one on each side of the seat. The expansion cylinders and the seat are supported by forelegs and hind legs that are pivotally positioned to allow toilet bowl height accommodation to virtually any toilet. One expansion cylinder is disposed on each hind leg. Expansion cylinders may be pneumatic or hydraulic. Each expansion cylinder is in either wireless or hardwired communication with control means. Control means are provided in more than one form and include a remote control, a wall-mount control, and a foot control, so that no toilet seat need be touched by hands. The legs and expansion cylinders are importantly compact and provide for placement immediately beside each side of a toilet bowl. Legs are downwardly fitted with non-slip feet. Elaborate, space-consuming, and complex designs are thereby avoided and further thereby allow for inexpensive manufacture, sale, and fit to virtually any toilet. Preparation for device fit involves only removal of an existing toilet seat. The existing seat lid may be retained or removed. The pivots may be frictionally engaged to retain leg positions chosen by a user. The pivots may also be mechanically adjustable for pivot, then firm leg relationship.

Thus has been broadly outlined the more important features of the improved power actuated toilet seat device so that the detailed description thereof that follows may be better understood and in order that the present contribution to the art may be better appreciated.

An object of the power actuated toilet seat device is to provide a power actuated toilet seat.

Another object of the power actuated toilet seat device is to provide for easily fitting virtually any toilet.

And, an object of the power actuated toilet seat device is to provide easy height adjustment in fitting a toilet.

A further object of the power actuated toilet seat device is to be as mechanically basic as possible.

An added object of the power actuated toilet seat device is to be compact.

Still another object of the power actuated toilet seat device is to negate any modifications to an existing toilet.

Another object of the power actuated toilet seat device is to provide more than one control means.

These together with additional objects, features and advantages of the improved power actuated toilet seat device will be readily apparent to those of ordinary skill in the art upon reading the following detailed description of presently preferred, but nonetheless illustrative, embodiments of the improved power actuated toilet seat device when taken in conjunction with the accompanying drawings.

DETAILED DESCRIPTION OF THE DRAWINGS

With reference now to the drawings, and in particular FIGS. 1 through 5 thereof, the principles and concepts of the power actuated toilet seat device generally designated by the reference number 10 will be described.

Figure 1:
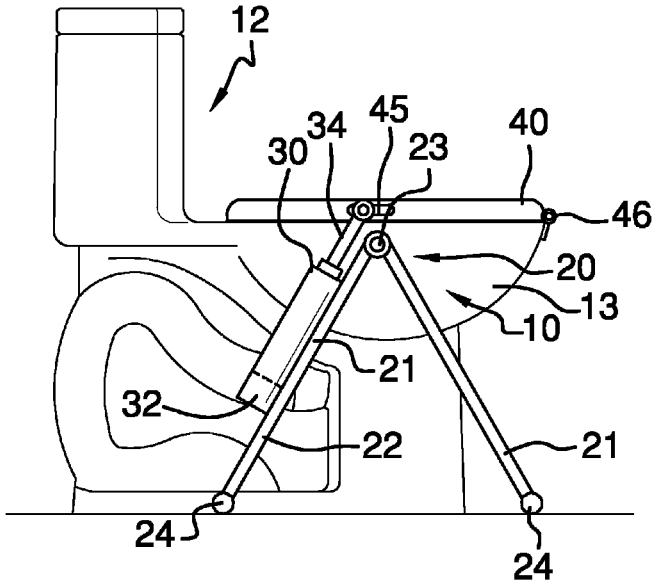
FIG. 1 is a lateral in-use elevation view.

Referring to FIG. 1, the device 10 partially comprises a pair of leg assemblies 20. Each leg assembly 20 comprises a foreleg 21 pivotally affixed to a hind leg 22 by an adjustably positioned pivot 23.

Figure 3:
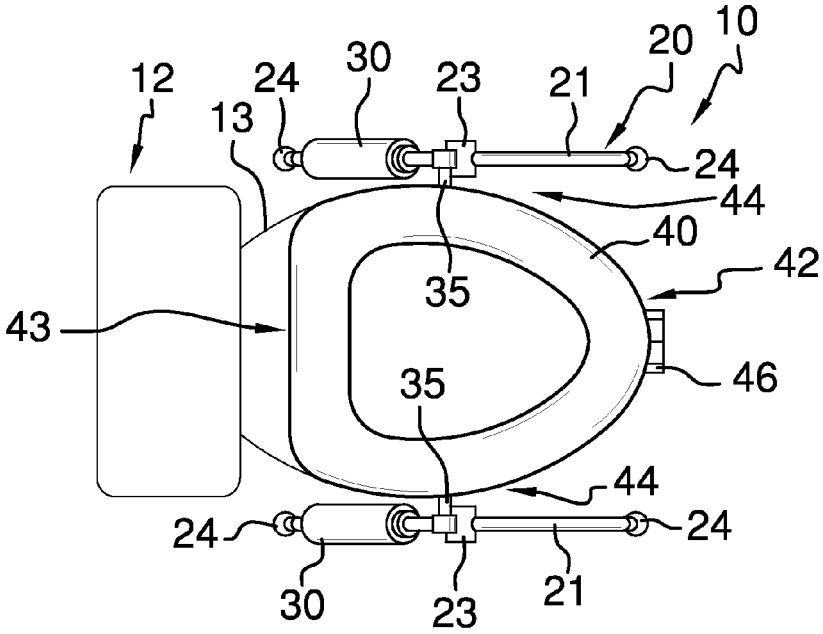
FIG. 3 is a top plan in-use view.

Referring to FIG. 3, a non-slip foot 24 is disposed downwardly on each leg.

Figure 2:
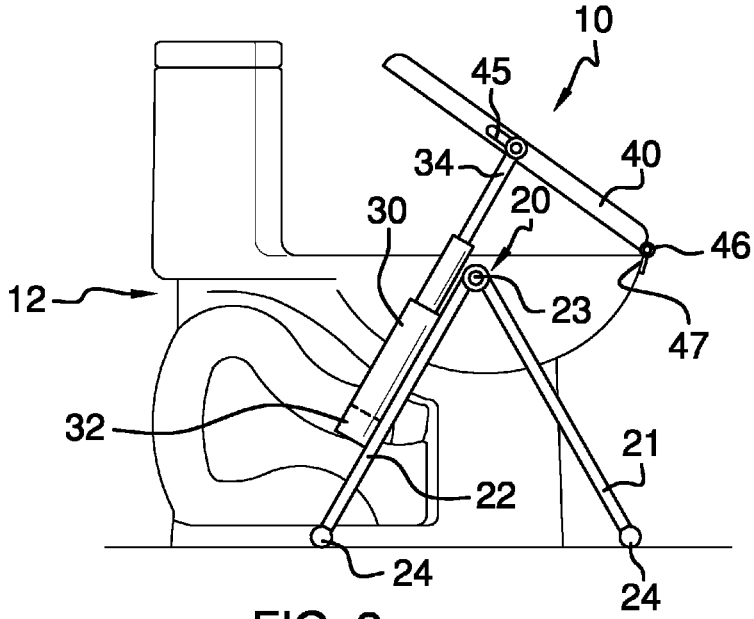
FIG. 2 is a lateral in-use elevation view, seat lifted.

Referring to FIG. 2, an expansion cylinder 30 is disposed longitudinally on each hind leg 22. A receiver/activator 32 is disposed downwardly in each expansion cylinder 30. An expansion lift arm 34 is disposed upwardly on each expansion cylinder 30.

Figure 4:
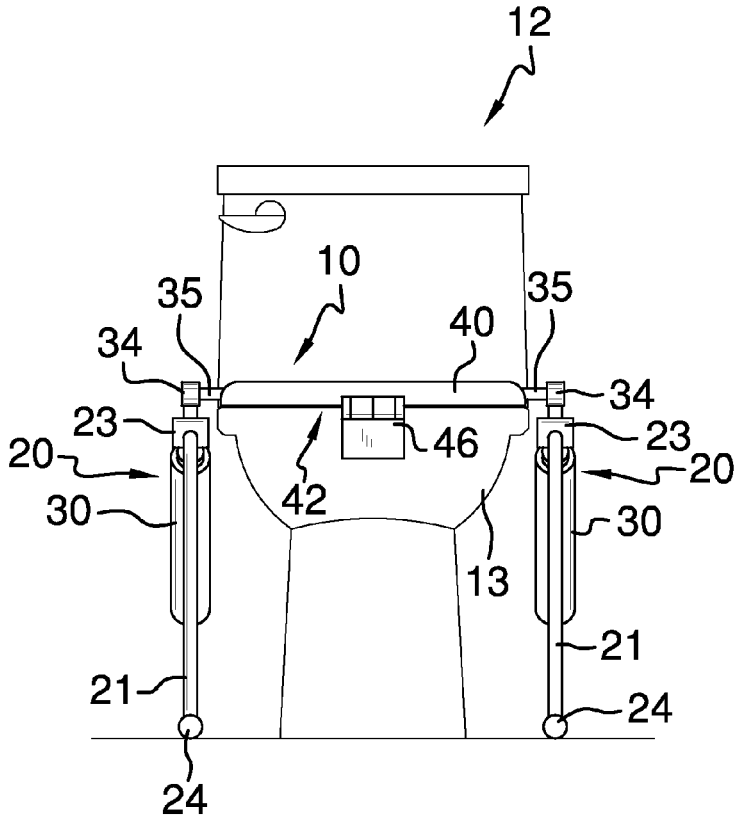
FIG. 4 is a front in-use view.

Referring to FIG. 4, a follower 35 is disposed perpendicularly inward atop each expansion lift arm 34.

Referring to FIG. 3, a seat 40 is provided. The seat 40 has a front 42 spaced apart from a rear 43, and two spaced apart sides 44 are connected to the front 42 and the rear 43.

Referring again to FIGS. 1 and 2, a slot 45 is disposed laterally within each seat 40 side 44. Each slot 45 is in receipt of one of the followers 35 of one of each of the expansion lift arms 34.

Referring again to FIG. 2 and FIG. 4, a hinge 46 is disposed downwardly and at the front 42 of the seat 40. The hinge 46 is selectively affixed forwardly to an existing bowl 13 of an existing toilet 12 via an adhesive 47. The hinge 46 is configured to allow lift and pivot of the seat 40 forwardly and upwardly.

Figure 5:
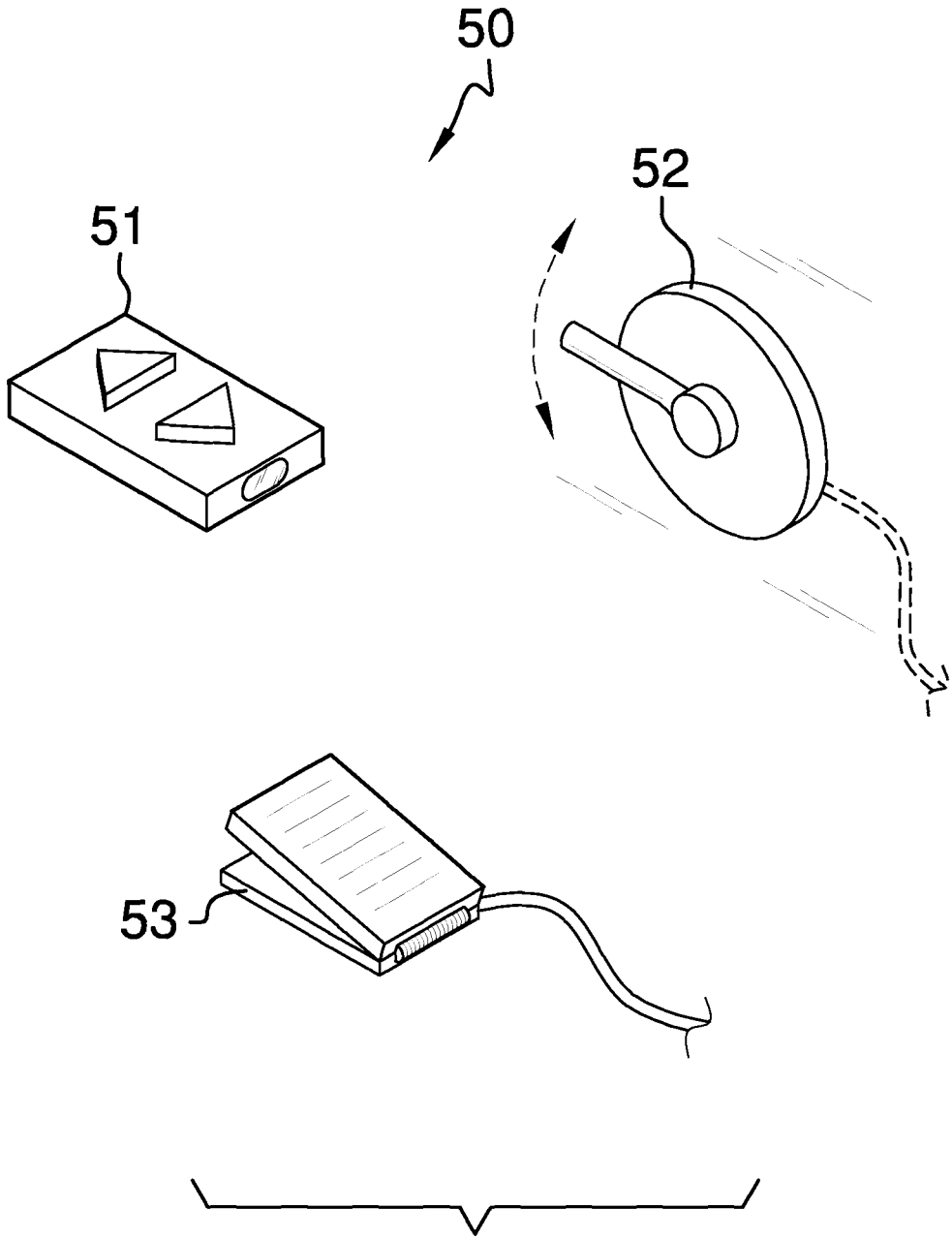
FIG. 5 is a perspective view of available controls.

Referring to FIG. 5, a control means 50 is configured to control lifting and pivoting of the seat 40. The control means 50 is in communication with each receiver/activator 32. The control means provided include a remote control 51, a wall-mount control 52 and a foot control 53.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the power actuated toilet seat device may be used.

What is claimed is:

1. A power actuated toilet seat device comprising, in combination:

a pair of leg assemblies, each leg assembly comprising a foreleg pivotally affixed to a hind leg by an adjustably positioned pivot;

a foot disposed downwardly on each leg;

an expansion cylinder disposed longitudinally on each hind leg;

a receiver/activator disposed downwardly in each expansion cylinder;

an expansion lift arm disposed upwardly on each expansion cylinder;

a follower disposed perpendicularly inward atop each expansion lift arm;

a seat having a front spaced apart from a rear, and two spaced apart sides, the sides connected to the front and the rear;

a slot disposed laterally within each seat side, each slot in receipt of one of the followers of one of each of the expansion lift arms;

a hinge disposed downwardly and at the front of the seat, the hinge selectively affixed forwardly to an existing bowl of an existing toilet via an adhesive, the hinge configured to allow lift and pivot of the seat forwardly and upwardly;

a control means configured to control lifting and pivoting of the seat, the control means in communication with each receiver/activator.

2. The device according to claim 1 wherein each expansion cylinder further comprises a hydraulic cylinder.

3. The device according to claim 1 wherein each expansion cylinder further comprises a pneumatic cylinder.

4. The device according to claim 1 wherein the adjustably positioned pivot is further frictionally adjustable.

5. The device according to claim 2 wherein the adjustably positioned pivot is further frictionally adjustable.

6. The device according to claim 3 wherein the adjustably positioned pivot is further frictionally adjustable.

7. The device according to claim 1 wherein the adjustably positioned pivot is further mechanically adjustable.

8. The device according to claim 2 wherein the adjustably positioned pivot is further mechanically adjustable.

9. The device according to claim 3 wherein the adjustably positioned pivot is further mechanically adjustable.

* * * * *